US008002913B2

(12) United States Patent
Khosla et al.

(10) Patent No.: US 8,002,913 B2
(45) Date of Patent: Aug. 23, 2011

(54) AA7000-SERIES ALUMINUM ALLOY PRODUCTS AND A METHOD OF MANUFACTURING THEREOF

(75) Inventors: Sunil Khosla, Beverwijk (NL); Andrew Norman, Beverwijk (NL); Hugo Van Schoonevelt, Noordbeemster (NL)

(73) Assignee: Aleris Aluminum Koblenz GmbH, Koblenz (DE)

( * ) Notice: Subject to any disclaimer, the term of this patent is extended or adjusted under 35 U.S.C. 154(b) by 70 days.

(21) Appl. No.: 11/773,904

(22) Filed: Jul. 5, 2007

(65) Prior Publication Data

US 2008/0173377 A1 Jul. 24, 2008

Related U.S. Application Data

(60) Provisional application No. 60/818,965, filed on Jul. 7, 2006.

(51) Int. Cl.

| | |
|---|---|
| ***C22F 1/04*** | (2006.01) |
| *C22C 21/00* | (2006.01) |
| *C22C 21/06* | (2006.01) |
| *C22C 21/10* | (2006.01) |

(52) U.S. Cl. ..... 148/552; 148/415; 148/417; 148/418; 148/550; 420/532; 420/534; 420/540; 420/542

(58) Field of Classification Search ..... 148/415, 148/417, 418, 550, 552; 420/529, 531–534, 420/540–542

See application file for complete search history.

(56) References Cited

U.S. PATENT DOCUMENTS

| | | | | |
|---|---|---|---|---|
| 2,249,349 | A | | 7/1941 | Deutsch |
| 3,287,185 | A | | 11/1966 | Vachet |
| 3,305,410 | A | | 2/1967 | Sublett et al. |
| 3,418,090 | A | | 12/1968 | Fritzlen |
| 3,674,448 | A | | 7/1972 | Brown et al. |
| 3,791,876 | A | | 2/1974 | Kroger |
| 3,791,880 | A | | 2/1974 | Hunsicker et al. |
| 3,794,531 | A | | 2/1974 | Markworth |
| 3,826,688 | A | | 7/1974 | Levy |
| 3,857,973 | A | | 12/1974 | McKee et al. |
| 3,881,966 | A | | 5/1975 | Staley et al. |
| 3,984,259 | A | | 10/1976 | Rogers, Jr. et al. |
| 4,140,549 | A | | 2/1979 | Chia et al. |
| 4,189,334 | A | | 2/1980 | Dubost et al. |
| 4,196,021 | A | | 4/1980 | Bouvaist et al. |
| 4,305,763 | A | | 12/1981 | Quist et al. |
| 4,462,843 | A | | 7/1984 | Baba et al. |
| 4,462,893 | A | | 7/1984 | Moriya et al. |
| 4,477,292 | A | | 10/1984 | Brown |
| 4,589,932 | A | | 5/1986 | Park |
| 4,618,382 | A | | 10/1986 | Miyagi et al. |
| 4,659,393 | A | | 4/1987 | Bouvaist et al. |
| 4,711,762 | A | | 12/1987 | Vernam et al. |
| 4,713,216 | A | | 12/1987 | Higashi et al. |
| 4,828,631 | A | | 5/1989 | Ponchel et al. |
| 4,927,470 | A | | 5/1990 | Cho |
| 4,946,517 | A | | 8/1990 | Cho |
| 4,954,188 | A | | 9/1990 | Ponchel et al. |
| 4,976,790 | A | | 12/1990 | McAuliffe et al. |
| 4,988,394 | A | | 1/1991 | Cho |
| 5,108,520 | A | | 4/1992 | Liu et al. |
| 5,186,235 | A | | 2/1993 | Word, Jr. |
| 5,213,639 | A | | 5/1993 | Colvin et al. |
| 5,221,377 | A | | 6/1993 | Hunt, Jr. et al. |
| 5,277,719 | A | * | 1/1994 | Kuhlman et al. ..... 148/694 |
| 5,312,498 | A | | 5/1994 | Anderson |
| 5,313,639 | A | | 5/1994 | Chao |
| 5,356,495 | A | | 10/1994 | Wyatt-Mair et al. |
| 5,496,423 | A | | 3/1996 | Wyatt-Mair et al. |
| 5,496,426 | A | | 3/1996 | Murtha |
| 5,560,789 | A | | 10/1996 | Sainfort et al. |
| 5,593,516 | A | | 1/1997 | Cassada, III |
| 5,624,632 | A | | 4/1997 | Baumann et al. |
| 5,681,405 | A | | 10/1997 | Newton et al. |
| 5,718,780 | A | | 2/1998 | Bryant et al. |
| 5,738,735 | A | | 4/1998 | Bechet |
| 5,833,775 | A | | 11/1998 | Newton et al. |
| 5,858,134 | A | | 1/1999 | Bechet et al. |
| 5,865,911 | A | | 2/1999 | Miyasato et al. |
| 5,865,914 | A | | 2/1999 | Karabin et al. |

(Continued)

FOREIGN PATENT DOCUMENTS

| | | |
|---|---|---|
| DE | 689 27 149 | 4/1997 |

(Continued)

OTHER PUBLICATIONS

Arai et al., ASM Handbook, Heat Treating of Aluminum Alloys-Strengthening by Heat Treatment, ASM International, vol. 4, 1995, p. 5-7.* Kuhlman, Forging of Aluminum Alloys—Forging Methods, ASM Handbook, 2005, ASM International, vol. 14A, p. 1-6.*
U.S. Appl. No. 11/773,919, Khosla et al., filed Jul. 5, 2007.
U.S. Appl. No. 11/773,900, Khosla et al., filed Jul. 5, 2007.
Airbus Industriele Material Specification AIMS 03-02-020 (Feb. 2002).
Hufnagel, W., Key to Aluminium Alloys, 4th Edition, Aluminium-Schluessel = Key to Aluminium Alloys, pp. 195-205 (XP-002194851) (1991).
International Preliminary Report on Patentability in application PCT/EP2007/005972 mailed on Jan. 22, 2009, international stage of U.S. Appl. No. 11/773,900, (11 pages).
International Preliminary Report on Patentability in application PCT/EP2007/005973 mailed on Jan. 22, 2009, international stage of U.S. Appl. No. 11/773,904 (12 pages).
International Preliminary Report on Patentability in application PCT/EP2007/005975 mailed on Jan. 22, 2009, international stage of U.S. Appl. No. 11/773,919, (12 pages).
Office action for U.S. Appl. No. 11/480,558, mailed Dec. 31, 2008 (14 pages).
Office action for U.S. Appl. No. 11/773,900, mailed Mar. 17, 2009 (13 pages).
Vojtech et al., Improving the casting properties of high-strength aluminum alloys, Materiali in Technologiji 38 (2004), pp. 99-102.
Office action for U.S. Appl. No. 11/773,919, mailed Mar. 16, 2009 (21 pages).
P.T. Houldcroft, "A Simple Cracking Test for Use with Argon-Arc Welding", British Welding Journal, Oct. 1955, pp. 471-475.
Pechiney Aluminium: "Demi produits aluminium; Caracteristiques generales—Aluminium mill products; general properties;" Oct. 1985, Announcement Pechiney Aluminium, pp. 1-5, XP002240985 the whole document.

(Continued)

*Primary Examiner* — Roy King
*Assistant Examiner* — Caitlin Fogarty
(74) *Attorney, Agent, or Firm* — Novak Druce + Quigg, LLP

(57) ABSTRACT

An AA7000-series alloy including 3 to 10% Zn, 1 to 3% Mg, at most 2.5% Cu, Fe <0.25%, and Si >0.12 to 0.35%, and a method of manufacturing these aluminum alloy products. More particularly, disclosed are aluminum wrought products in relatively thick gauges, in particular i.e. about 30 to 300 mm thick. While typically practiced on rolled plate product forms, this method may also find use with manufacturing extrusions or forged product shapes. Representative structural component parts made from the alloy product include integral spar members, and the like, which are machined from thick wrought sections, including rolled plate.

45 Claims, No Drawings

U.S. PATENT DOCUMENTS

| | | | |
|---|---|---|---|
| 5,888,320 | A | 3/1999 | Dorward |
| 5,938,867 | A | 8/1999 | Dorward et al. |
| 6,027,582 | A | 2/2000 | Shahani et al. |
| 6,120,623 | A | 9/2000 | Gupta et al. |
| 6,129,792 | A | 10/2000 | Murtha |
| 6,224,992 | B1 | 5/2001 | Delbeke et al. |
| 6,238,495 | B1 | 5/2001 | Haszler |
| 6,315,842 | B1 | 11/2001 | Shahani et al. |
| 6,337,147 | B1 | 1/2002 | Haszler et al. |
| 6,444,058 | B1 | 9/2002 | Liu et al. |
| 6,543,122 | B1 | 4/2003 | Perkins et al. |
| 6,562,154 | B1 | 5/2003 | Rioja et al. |
| 6,569,542 | B2 | 5/2003 | Warner et al. |
| 6,602,361 | B2 | 8/2003 | Warner et al. |
| 6,627,330 | B1 | 9/2003 | Shimizu et al. |
| 6,652,678 | B1 | 11/2003 | Marshall et al. |
| 6,726,878 | B1 | 4/2004 | Flidlyander et al. |
| 6,743,308 | B2 | 6/2004 | Tanaka et al. |
| 6,790,407 | B2 | 9/2004 | Fridlyander |
| 6,972,110 | B2 | 12/2005 | Chakrabarti et al. |
| 6,994,760 | B2 | 2/2006 | Benedictus et al. |
| 7,060,139 | B2 | 6/2006 | Senkovet et al. |
| 7,097,719 | B2 | 8/2006 | Bray et al. |
| 7,250,223 | B2 | 7/2007 | Miyachi et al. |
| 7,294,213 | B2 | 11/2007 | Warner et al. |
| 7,550,110 | B2 | 6/2009 | Warner et al. |
| 7,666,267 | B2 * | 2/2010 | Benedictus et al. |
| 2001/0006082 | A1 | 7/2001 | Warner et al. |
| 2001/0039982 | A1 | 11/2001 | Sigli et al. |
| 2002/0011289 | A1 | 1/2002 | Warner |
| 2002/0014288 | A1 | 2/2002 | Warner et al. |
| 2002/0014290 | A1 | 2/2002 | Dif et al. |
| 2002/0039664 | A1 | 4/2002 | Magnusen et al. |
| 2002/0043311 | A1 | 4/2002 | Selepack et al. |
| 2002/0121319 | A1 | 9/2002 | Chakrabarti et al. |
| 2002/0150498 | A1 | 10/2002 | Chakrabarti et al. |
| 2002/0153072 | A1 | 10/2002 | Tanaka et al. |
| 2002/0162609 | A1 | 11/2002 | Warner |
| 2003/0140990 | A1 | 7/2003 | Ribes et al. |
| 2003/0219353 | A1 | 11/2003 | Warner et al. |
| 2004/0007295 | A1 | 1/2004 | Lorentzen et al. |
| 2004/0101434 | A1 | 5/2004 | Fridlyander et al. |
| 2004/0109787 | A1 | 6/2004 | Haszler et al. |
| 2004/0211498 | A1 | 10/2004 | Keidel et al. |
| 2005/0006010 | A1 | 1/2005 | Benedictus et al. |
| 2005/0034794 | A1 | 2/2005 | Benedictus et al. |
| 2005/0067066 | A1 | 3/2005 | Tanaka et al. |
| 2005/0072497 | A1 | 4/2005 | Eberl et al. |
| 2005/0081965 | A1 | 4/2005 | Benedictus et al. |
| 2005/0095447 | A1 | 5/2005 | Baumann et al. |
| 2005/0189044 | A1 | 9/2005 | Benedictus et al. |
| 2006/0016523 | A1 | 1/2006 | Dif et al. |
| 2006/0032560 | A1 | 2/2006 | Benedictus et al. |
| 2006/0174980 | A1 | 8/2006 | Benedictus et al. |
| 2006/0182650 | A1 | 8/2006 | Eberl et al. |
| 2007/0000583 | A1 | 1/2007 | Rioja et al. |
| 2007/0151636 | A1 | 7/2007 | Buerger |
| 2007/0204937 | A1 | 9/2007 | Buerger |
| 2008/0173378 | A1 | 7/2008 | Khosla et al. |
| 2008/0210349 | A1 | 9/2008 | Khosla et al. |
| 2009/0269608 | A1 | 10/2009 | Benedictus et al. |
| 2009/0320969 | A1 | 12/2009 | Benedictus et al. |

FOREIGN PATENT DOCUMENTS

| | | | |
|---|---|---|---|
| DE | 10 2004 010700 | | 10/2004 |
| DE | 103 92 805 | | 6/2005 |
| EP | 0081441 | | 6/1983 |
| EP | 0 368 005 | | 5/1990 |
| EP | 0 377 779 | | 7/1990 |
| EP | 0 587 274 | | 3/1994 |
| EP | 0 605 947 | | 7/1994 |
| EP | 0670377 | | 9/1995 |
| EP | 0 799 900 | | 10/1997 |
| EP | 0 829 552 | | 3/1998 |
| EP | 0876514 | | 11/1998 |
| EP | 989195 | | 3/2000 |
| EP | 1026270 | | 8/2000 |
| EP | 1045043 | | 10/2000 |
| EP | 1114877 | | 7/2001 |
| EP | 1143027 | | 10/2001 |
| EP | 1158068 | | 11/2001 |
| EP | 1 170 394 | | 1/2002 |
| EP | 1231290 | | 8/2002 |
| EP | 1 306 455 | | 5/2003 |
| EP | 1382698 | A1 | 1/2004 |
| FR | 1508123 | | 1/1968 |
| FR | 2066696 | | 8/1971 |
| FR | 2163281 | A5 | 7/1973 |
| FR | 2234375 | | 1/1975 |
| FR | 2409319 | | 6/1979 |
| FR | 2472618 | | 7/1981 |
| FR | 2716896 | | 9/1995 |
| FR | 2841263 | | 12/2003 |
| FR | 2846669 | | 5/2004 |
| FR | 2855834 | | 12/2004 |
| GB | 925956 | B | 5/1963 |
| GB | 0952288 | | 3/1964 |
| GB | 1029486 | | 5/1966 |
| GB | 1231090 | | 5/1971 |
| GB | 1273261 | | 5/1972 |
| GB | 1427657 | | 3/1976 |
| GB | 2065516 | | 7/1981 |
| GB | 1603690 | | 11/1981 |
| GB | 2 114 601 | | 8/1983 |
| GB | 2430937 | | 4/2007 |
| JP | 59126762 | | 7/1984 |
| JP | 61-049796 | | 3/1986 |
| JP | 62010246 | | 1/1987 |
| JP | 62-122744 | | 6/1987 |
| JP | 62-122745 | | 6/1987 |
| JP | 63-319143 | | 12/1988 |
| JP | 1-039340 | | 2/1989 |
| JP | 1-208438 | | 8/1989 |
| JP | 2-047244 | | 2/1990 |
| JP | 06128678 | | 5/1994 |
| JP | 6-228691 | | 8/1994 |
| JP | 8120385 | | 5/1996 |
| JP | 8144031 | | 6/1996 |
| JP | 10280081 | | 10/1998 |
| JP | 10298692 | | 11/1998 |
| JP | 2001020028 | | 1/2001 |
| JP | 2001115227 | | 4/2001 |
| JP | 2002/241882 | | 8/2002 |
| JP | 2003147498 | | 5/2003 |
| RU | 2 044 098 | | 9/1995 |
| RU | 2 165 996 | | 4/2001 |
| RU | 2184166 | C2 | 6/2002 |
| RU | 2 215 808 | | 11/2003 |
| RU | 2215807 | C2 | 11/2003 |
| SU | 664 570 | | 5/1979 |
| SU | 664570 | | 5/1979 |
| SU | 1 625 043 | | 10/1995 |
| WO | 9203586 | | 3/1992 |
| WO | 95/26420 | | 10/1995 |
| WO | 9610099 | | 4/1996 |
| WO | 96/28582 | | 9/1996 |
| WO | 96/29440 | | 9/1996 |
| WO | 97/22724 | | 6/1997 |
| WO | 98/37251 | | 8/1998 |
| WO | 00/54967 | | 9/2000 |
| WO | 02/10468 | | 2/2002 |
| WO | 02/052053 | | 7/2002 |
| WO | 02/075010 | | 9/2002 |
| WO | 03/076677 | | 9/2003 |
| WO | 03085146 | | 10/2003 |
| WO | 2004/001080 | | 12/2003 |
| WO | 2004/044256 | | 5/2004 |
| WO | 2004111282 | | 12/2004 |
| WO | 2005003398 | | 1/2005 |

OTHER PUBLICATIONS

M.S. degree thesis of L.E. Oswald, titled "Effects of microstructure on high-cycle fatigue of an Al-Zn-Mg-Cu alloy (AL-7055)", pp. i-x and 1-54 (Apr. 2003).

Office action of Jul. 15, 2009 from U.S. Appl. No. 11/480,558.

Office action of Sep. 9, 2009 from U.S. Appl. No. 11/566,630.

Office action of Sep. 25, 2009 from U.S. Appl. No. 11/773,919.
Office action of Sep. 24, 2009 from U.S. Appl. No. 11/773,900.
Advisory action of Oct. 30, 2009 from U.S. Appl. No. 11/480,558.
Non-Final Rejection dated Mar. 4, 2010, in co-pending U.S. Appl. No. 11/773,900.
Conversion table for hardness and tensile strength value-DIN EN ISO 18265—Nov. 2003.
Final Rejection dated Mar. 11, 2010, in co-pending U.S. Appl. No. 11/566,630.
"Heat Treating of Aluminum Alloys," ASM Handbook, vol. 4, pp. 841-856, 1995.
Lakhtin Yu. M. et al. Material Science, Moscow, "Machine Construction" 1980, p. 40.
V.I. Dobatkin, Smelting and Casting of Aluminum Alloys, Moscow, "Metallurgy", 1970, p. 27.
The Russian State Standard GOST 4784-97; Aluminum and wrought aluminum alloys , rades, Minsk, Publisher or Standards, 1999, p. 7, 8, Table 6.
International Alloy Designations and Chemical Composition Limits for Wrought Aluminum and Wrought Aluminum Alloys (teak sheets), The Aluminum Association, miscellaneous annotated pages (Jul. 1998).
"Aluminum Viewed from Within", Altenpohl, 1st edition, pp. 118-131 (1982).
ASM Specialty Handbook, Aluminum and Aluminum Alloys, edited by J.R. Davis, ASM International, pp. 247-248, 1993.
Aluminum Properties and Physical Metallurgy, edited by J.E. Hatch, American Society for Metals, p. 112-113 (1984).
Aluminium-Taschenbuch 15. Auflage, Dorossel et al., p. 20-25 (1999).
Advisory Action mailed in U.S. Appl. No. 11/773,919 on Dec. 15, 2009, 3 pages.
Non-Final Rejection mailed in U.S. Appl. No. 11/773,919 on Jun. 8, 2010, 14 pages.
Advisory Action mailed in U.S. Appl. No. 11/773,900 on Jan. 11, 2010, 3 pages.
Advisory Action mailed in U.S. Appl. No. 11/566,630 on Jun. 24, 2010, 3 pages.
Requirement for Restriction / Election mailed in U.S. Appl. No. 11/566,630 on Jun. 19, 2009, 6 pages.
Final Rejection mailed in U.S. Appl. No. 12/547,466 on Jul. 12, 2010, 13 pages.
Non-Final Rejection mailed in U.S. Appl. No. 12/547,466 on Jan. 28, 2010, 11 pages.
Advisory Action mailed in U.S. Appl. No. 10/819,130 on May 6, 2008, 4 pages.
Advisory Action mailed in U.S. Appl. No. 10/819,130 on Jul. 13, 2009, 3 pages.
Final Rejection mailed in U.S. Appl. No. 10/819,130 on Jan. 25, 2008, 9 pages.
Final Rejection mailed in U.S. Appl. No. 10/819,130 on Feb. 26, 2009, 7 pages.
Non-Final Rejection mailed in U.S. Appl. No. 10/819,130 on Jun. 22, 2007, 8 pages.
Non-Final Rejection mailed in U.S. Appl. No. 10/819,130 on Aug. 5, 2008, 8 pages.
Requirement for Restriction / Election mailed in U.S. Appl. No. 10/819,130 on Apr. 3, 2007, 5 pages.
Advisory Action mailed in U.S. Appl. No. 10/821,184 on Jun. 4, 2008, 4 pages.
Final Rejection mailed in U.S. Appl. No. 10/821,184 on Nov. 21, 2008, 9 pages.
Final Rejection mailed in U.S. Appl. No. 10/821,184 on Feb. 21, 2008, 14 pages.
Non-Final Rejection mailed in U.S. Appl. No. 10/821,184 on Jun. 26, 2007, 11 pages.
Non-Final Rejection mailed in U.S. Appl. No. 10/821,184 on Sep. 3, 2008, 14 pages.
Requirement for Restriction / Election mailed in U.S. Appl. No. 10/821,184 on Apr. 3, 2007, 5 pages.
Advisory Action mailed in U.S. Appl. No. 10/976,154 on Nov. 21, 2008, 4 pages.
Final Rejection mailed in U.S. Appl. No. 10/976,154 on Oct. 15, 2009, 17 pages.
Final Rejection mailed in U.S. Appl. No. 10/976,154 on May 29, 2008, pages.
Non-Final Rejection mailed in U.S. Appl. No. 10/976,154 on Feb. 18, 2009, 16 pages.
Non-Final Rejection mailed in U.S. Appl. No. 10/976,154 on Sep. 20, 2007, 15 pages.
Advisory Action mailed in U.S. Appl. No. 11/239,651 on Feb. 24, 2009, 3 pages.
Advisory Action mailed in U.S. Appl. No. 11/239,651 on Mar. 23, 2010, 3 pages.
Final Rejection mailed in U.S. Appl. No. 11/239,651 on Oct. 14, 2008, 10 pages.
Final Rejection mailed in U.S. Appl. No. 11/239,651 on Dec. 7, 2009, 10 pages.
Non-Final Rejection mailed in U.S. Appl. No. 11/239,651 on Feb. 22, 2008, 13 pages.
Non-Final Rejection mailed in U.S. Appl. No. 11/239,651 on Jun. 1, 2009, 10 pages.
Non-Final Rejection mailed in U.S. Appl. No. 11/239,651 on Jun. 8, 2010, 20 pages.
Non-Final Rejection mailed in U.S. Appl. No. 12/497,987 on May 26, 2010, 10 pages.
U.S. Appl. No. 11/733,900—Final Office action mailed Aug. 8, 2010.
U.S. Appl. No. 11/239,651—Notice of Allowance mailed Sep. 24, 2010.
U.S. Appl. No. 12/547,466—Non-Final Office action mailed Mar. 31, 2011.
U.S. Appl. No. 11/566,630—Final Office action mailed Apr. 5, 2011.
U.S. Appl. No. 11/773,919—Advisory Office action mailed Mar. 7, 2011.
U.S. Appl. No. 12/497,987—Final Office action mailed Jan. 6, 2011.
U.S. Appl. No. 11/733,919—Final Office action mailed Nov. 18, 2010.
U.S. Appl. No. 11/566,630—Non-Final Office action mailed Nov. 29, 2010.
ASM Specialty Handbook Aluminum and Aluminum Alloys, J.R. Davis, ASM International, pp. 290-295 and 319-320 (1993).

* cited by examiner

AA7000-SERIES ALUMINUM ALLOY PRODUCTS AND A METHOD OF MANUFACTURING THEREOF

CROSS REFERENCE TO RELATED APPLICATION

This claims the benefit of U.S. provisional application No. 60/818,965, filed Jul. 7, 2006, incorporated herein by reference.

FIELD OF THE INVENTION

This invention relates to an AA7000-series alloy comprising 3 to 10% Zn, 1 to 3% Mg, at most 2.5% Cu, Fe <0.25%, and Si >0.12 to 0.35%, and to a method of manufacturing these aluminum alloy products. More particularly, the invention relates to aluminum wrought products in relatively thick gauges, in particular i.e. about 30 to 300 mm thick. While typically practiced on rolled plate product forms, this invention may also find use with manufacturing extrusions or forged product shapes. Representative structural component parts made from the alloy product include integral spar members and the like which are machined from thick wrought sections, including rolled plate. This invention is particularly suitable for manufacturing high strength extrusions and forged aircraft components. Such aircraft include commercial passenger jetliners, cargo planes and certain military planes. In addition, non-aerospace parts like various thick mould plates or tooling plates may be made according to this invention.

BACKGROUND TO THE INVENTION

As will be appreciated herein below, except as otherwise indicated, alloy designations and temper designations refer to the Aluminum Association designations in Aluminum Standards and Data and the Registration Records, as published by the Aluminum Association in 2006.

For any description of alloy compositions or preferred alloy compositions, all references to percentages are by weight percent unless otherwise indicated.

Different types of aluminum alloys have been used in the past for forming a variety of products for structural applications in the aerospace industry. Designers and manufacturers in the aerospace industry are constantly trying to improve fuel efficiency, product performance and constantly trying to reduce the manufacturing and service costs. The preferred method for achieving the improvements, together with the cost reduction, is the uni-alloy concept, i.e. one aluminum alloy that is capable of having improved property balance in the relevant product forms.

State of the art at this moment is high damage tolerant AA2x24 (i.e. AA2524) or AA6x13 or AA7x75 for fuselage sheet, AA2324 or AA7x75 for lower wing, AA7055 or AA7449 for upper wing and AA7050 or AA7010 or AA7040 or AA7140 for wing spars and ribs or other sections machined from thick plate. The main reason for using different alloys for each different application is the difference in the property balance for optimum performance of the whole structural part.

For fuselage skin, damage tolerant properties under tensile loading are considered to be very important, that is a combination of fatigue crack growth rate ("FCGR"), plane stress fracture toughness and corrosion. Based on these property requirements, high damage tolerant AA2×24-T351 (see e.g. U.S. Pat. No. 5,213,639 or EP-1026270-A1) or Cu containing AA6xxx-T6 (see e.g. U.S. Pat. No. 4,589,932, U.S. Pat. No. 5,888,320, US-2002/0039664-A1 or EP-1143027-A1) would be the preferred choice of civilian aircraft manufactures.

For lower wing skin a similar property balance is desired, but some toughness is allowably sacrificed for higher tensile strength. For this reason AA2x24 in the T39 or a T8x temper are considered to be logical choices (see e.g. U.S. Pat. No. 5,865,914, U.S. Pat. No. 5,593,516 or EP-1114877-A1).

For upper wing, where compressive loading is more important than the tensile loading, the compressive strength, fatigue (SN-fatigue or life-time or FCGR) and fracture toughness are the most critical properties. Currently, the preferred choice would be AA7150, AA7055, AA7449 or AA7x75 (see e.g. U.S. Pat. No. 5,221,377, U.S. Pat. No. 5,865,911, U.S. Pat. No. 5,560,789 or U.S. Pat. No. 5,312,498). These alloys have high compressive yield strength with at the moment acceptable corrosion resistance and fracture toughness, although aircraft designers would welcome improvements on these property combinations.

For thick sections having a thickness of more than 3 inch or parts machined from such thick sections, a uniform and reliable property balance through thickness is important. Currently, AA7050 or AA7010 or AA7040 (see U.S. Pat. No. 6,027,582) or AA7085 (see e.g. US Patent Application Publication No. 2002/0121319-A1 and U.S. Pat. No. 6,972,110) are used for these types of applications. Reduced quench sensitivity, that is deterioration of properties through thickness with lower quenching speed or thicker products, is a major wish from the aircraft manufactures. Especially the properties in the ST-direction are a major concern of the designers and manufactures of structural parts.

A better performance of the aircraft, i.e. reduced manufacturing cost and reduced operation cost, can be achieved by improving the property balance of the aluminum alloys used in the structural part and preferably using only one type of alloy to reduce the cost of the alloy and to reduce the cost in the recycling of aluminum scrap and waste.

Accordingly, it is believed that there is a demand for an aluminum alloy capable of achieving the improved proper property balance in almost every relevant product form.

DESCRIPTION OF THE INVENTION

It is an object of the present invention to provide AA7000-series alloys having improved property balance.

It is another object of the present invention to provide a wrought aluminum alloy product of an AA7000-series alloy comprising 3 to 10% Zn, 1 to 3% Mg, at most 2.5% Cu, Fe <0.25%, and Si >0.12 to 0.35% having improved properties, in particular having improved fracture toughness.

It is another object of the present invention to provide a method of manufacturing such improved AA7000-series alloy products.

These and other objects and further advantages are met or exceeded by the present invention method of manufacturing a wrought aluminum alloy product of an AA7000-series alloy comprising Si >0.12 to 0.35%, and preferably comprising 3 to 10% Zn, 1 to 3% Mg, at most 2.5% Cu, Fe <0.25%, and Si >0.12 to 0.35%, the method comprising the steps of:

a. casting stock of an ingot of the defined AA7000-series aluminum alloy composition,
b. preheating and/or homogenising the cast stock;
c. hot working the stock by one or more methods selected from the group consisting of rolling, extrusion, and forging;
d. optionally cold working the hot worked stock;

e. solution heat treating (SHT) of the hot worked and optionally cold worked stock at a temperature and time sufficient to place into solid solution the soluble constituents in the aluminum alloy;

f. cooling the SHT stock, preferably by one of spray quenching or immersion quenching in water or other quenching media;

g. optionally stretching or compressing the cooled SHT stock or otherwise cold working the cooled SHT stock to relieve stresses, for example levelling or drawing or cold rolling of the cooled SHT stock;

h. ageing of the cooled and optionally stretched or compressed or otherwise cold worked SHT stock to achieve a desired temper.

According to this invention there is at least one heat treatment carried out at a temperature in a range of more than 500° C. but lower than the solidus temperature of the subject AA7000 aluminum alloy, and wherein this heat treatment is carried out either: (i) after the homogenisation heat treatment but prior to hot working, or (ii) after the solution heat treatment of step e.), or (iii) both after the homogenisation heat treatment but prior to hot working and also after the solution heat treatment of step e.).

The aluminum alloy can be provided as an ingot or slab or billet for fabrication into a suitable wrought product by casting techniques regular in the art for cast products, e.g. DC-casting, EMC-casting, EMS-casting. Slabs resulting from continuous casting, e.g. belt casters or roll casters, also may be used, which in particular may be advantageous when producing thinner gauge end products. Grain refiners such as those containing titanium and boron, or titanium and carbon, may also be used as is well-known in the art. After casting the alloy stock, the ingot is commonly scalped to remove segregation zones near the cast surface of the ingot.

It is known in the art that the purpose of a homogenisation heat treatment has the following objectives: (i) to dissolve as much as possible coarse soluble phases formed during solidification, and (ii) to reduce concentration gradients to facilitate the dissolution step. A preheat treatment achieves also some of these objectives. A typical preheat treatment for AA7000-series alloys would be a temperature of 420 to 460° C. with a soaking time in the range of 3 to 50 hours, more typically for 3 to 20 hours.

Firstly, the soluble eutectic phases such as the S-phase, T-phase, and M-phase in the alloy stock are dissolved using regular industry practice. This is typically carried out by heating the stock to a temperature of less than 500° C., and typically in a range of 450 to 485° C., as the S-phase eutectic phase ($Al_2MgCu$-phase) has a melting temperature of about 489° C. in AA7000-series alloys and the M-phase ($MgZn_2$-phase) has a melting point of about 478° C. As is known in the art this can be achieved by a homogenisation treatment in said temperature range and allowing the stock to cool to the hot working temperature, or after homogenisation the stock is subsequently cooled and reheated to hot working temperature. The regular homogenisation process can also be done in two or more steps if desired, and which are typically carried out in a temperature range of 430 to 490° C. for AA7000-series alloys. For example in a two step process, there is a first step between 457 and 463° C., and a second step between 470 and 485° C., to optimise the dissolving process of the various phases depending on the exact alloy composition.

The soaking time at the homogenisation temperature according to industry practice is alloy dependent as is well known to the skilled person, and is commonly in the range of about 1 to 50 hours. The heat-up rates that can be applied are those which are regular in the art.

This is where the homogenisation practice according to the prior art stops. However, it is an important aspect of the present invention that after the regular homogenisation practice where the alloy composition allows complete dissolution of soluble phases (eutectics) present from solidification at least one further heat treatment can be carried out at a temperature in a range of more than 500° C. but at a temperature lower than the solidus temperature of the subject alloy.

For the AA7000-series alloys the preferred temperature is in a range of >500 to 550° C., preferably 505 to 540° C., and more preferably 510 to 535° C., and more preferably of at least 520° C.

For the alloy system the soaking time at this further heat treatment is from about 1 to up about 50 hours. A more practical soaking time would not be more than about 30 hours, and preferably not more than about 15 hours. A too long soaking time may lead to an undesired coarsening of dispersoids adversely affecting the mechanical properties of the final alloy product.

The skilled person will immediately recognise that at least the following alternative homogenisation practices can be used, while achieving the same technical effect:

(a) regular homogenisation according to industry practice, wherein afterwards the temperature is further raised to carry out the additional step according to this invention, followed by cooling to hot working temperature, such as, for example, 470° C.

(b) as alternative (a), but wherein after the additional step according to this invention the stock is cooled, for example to ambient temperature, and subsequently reheated to hot working temperature.

(c) as alternative (a), but wherein between the heat treatment according to regular industry practice and the further heat treatment according to this invention the stock is being cooled, for example to below 150° C. or to ambient temperature, (d) a practice wherein between the various steps (regular practice, heat treatment according to invention, and heating to hot working temperature) the stock is cooled, for example to below 150° C. or to ambient temperature, where after it is reheated to the relevant temperature.

In the alternatives wherein following the heat treatment according to this invention the stock is firstly cooled to, for example, ambient temperature prior to reheating for hot working, preferably a fast cooling rate is used to prevent or at least minimise uncontrolled precipitation of various secondary phases, e.g. $Al_2CuMg$ or $Al_2Cu$ or $Mg_2Zn$.

Following the preheat and/or homogenisation practice according to this invention the stock can be hot worked by one or more methods selected from the group consisting of rolling, extrusion, and forging, preferably using regular industry practice. The method of hot rolling is preferred for the present invention.

The hot working, and hot rolling in particular, may be performed to a final gauge, e.g. 3 mm or less or alternatively thick gauge products. Alternatively, the hot working step can be performed to provide stock at intermediate gauge, typical sheet or thin plate. Thereafter, this stock at intermediate gauge can be cold worked, e.g. by means of rolling, to a final gauge. Depending on the alloy composition and the amount of cold work an intermediate anneal may be used before or during the cold working operation.

In an embodiment of the method according to this invention following the regular practice of SHT and fast cooling for the subject aluminum alloy product, the stock is subjected to the further heat treatment according to this invention, one may designate this as a second SHT, at a higher temperature than the first regular SHT, where after the stock is rapidly cooled to avoid undesirable precipitation out of various phases. Between the first and second SHT the stock can be rapidly cooled according to regular practice, or alternatively the stock is ramped up in temperature from the first SHT to the second SHT and after a sufficient soaking time it is subsequently rapidly cooled. This second SHT is to further enhance the properties in the alloy products and is preferably carried out in the same temperature range and time range as the homogenisation treatment according to this invention as set out in this description, together with the preferred narrower ranges. However, it is believed that also shorter soaking times can still be very useful, for example in the range of about 2 to 180 minutes. This further heat treatment may dissolve as much as practically possible any of the $Mg_2Si$ phases which may have precipitated out during cooling from the homogenisation treatment or the during a hot working operation or any other intermediate thermal treatment. The solution heat treatment is typically carried out in a batch furnace, but can also be carried out in a continuous fashion. After solution heat treatment, it is important that the aluminum alloy be cooled to a temperature of 175° C. or lower, preferably to ambient temperature, to prevent or minimise the uncontrolled precipitation of secondary phases, e.g. $Al_2CuMg$ and $Al_2Cu$, and/or $Mg_2Zn$. On the other hand cooling rates should preferably not be too high in order to allow for a sufficient flatness and low level of residual stresses in the product. Suitable cooling rates can be achieved with the use of water, e.g. water immersion or water jets.

Yet, in a further embodiment of this invention the defined AA7000-series alloy products are processed using regular homogenisation and/or preheat practice, and where after the products are processed using the preferred SHT as set out above, thus regular SHT followed by the second solution heat treatment in the defined temperature and time range, together with the preferred narrower ranges. This will result in the same advantages in product properties. It is possible to carry out the first regular SHT followed by rapid cooling and reheating to the soaking temperature of the second SHT, alternatively the temperature is ramped up from the first to the second SHT and after a sufficient soaking time it is subsequently rapidly cooled.

The stock may be further cold worked, for example, by stretching in the range of about 0.5 to 8% of its original length to relieve residual stresses therein and to improve the flatness of the product. Preferably the stretching is in the range of about 0.5 to 6%, more preferably of about 0.5 to 5%.

After cooling the stock is aged, typically at ambient temperatures, and/or alternatively the stock can be artificially aged. The artificial ageing can be of particular use for higher gauge products. Depending on the alloy system this ageing can de done by natural ageing, typically at ambient temperatures, or alternatively by means of artificially ageing. All ageing practices known in the art and those which may be subsequently developed can be applied to the AA7000-series alloy products obtained by the method according to this invention to develop the required strength and other engineering properties.

A desired structural shape is then machined from these heat treated plate sections, more often generally after artificial ageing, for example, an integral wing spar. SHT, quench, optional stress relief operations and artificial ageing are also followed in the manufacture of thick sections made by extrusion and/or forged processing steps.

The effect of the heat treatment according to this invention is that the damage tolerance properties are improved of the alloy product compared to the same aluminum alloy having also high Si content but processed without this practice according to the present invention. In particular an improvement can be found in one or more of the following properties: the fracture toughness, the fracture toughness in S-L orientation, the fracture toughness in S-T orientation, the elongation at fracture, the elongation at fracture in ST orientation, the fatigue properties, in particular FCGR, S-N fatigue or axial fatigue, the corrosion resistance, in particular exfoliation corrosion resistance, or SCC or IGC. It has been shown that there is a significant enhancement in mechanical properties of as much as 15%, and in the best examples of more than 20%.

In addition, similar enhanced properties are achieved, or at least not adversely affected, with the aluminum alloy products according to this invention and preferably processed according to this invention compared to the same alloy composition but having the regular low Si content and processed according to regular industry practice. This would allow the manufacturing of aluminum alloy product having similar or equivalent properties compared to the low Si alloys, but in a more cost effective manner as source material having a low Si-content is more expensive.

The following explanation for the surprisingly improved properties of the wrought product of this invention is put forward, with the caveat that it is merely an expression on belief and does not presently have complete experimental support.

The prior art refers to the $Mg_2Si$ constituent phase as being insoluble in AA7000-series aluminum alloys and these particles are known fatigue initiation sites. In particular for aerospace applications, the prior art indicates that the Fe and Si content need to be controlled to very low levels to provide products with improved damage tolerant properties such as Fatigue Crack Growth Rate resistance ("FCGR") and fracture toughness. From various prior art documents it is clear that the Si content is treated as an impurity and should be kept at a level as low as reasonably possible. For example US-2002/0121319-A1, incorporated herein by reference, discusses the impact of these impurities on the alloying additions and states that Si will tie up some Mg thereby leaving an "Effective Mg" content available for solution, it is suggested that this be remedied by additional additions of Mg to compensate for the Mg tied up with the $Mg_2Si$, see section [0030] of US-2002/0121319-A1. However, at no point it is suggested that the $Mg_2Si$ could be reintroduced into solution by a controlled heat treatment practice. With regard to the homogenisation practice it is mentioned that homogenisation may be conducted in a number of controlled steps but ultimately state that a preferred combined total volume fraction of soluble and insoluble constituents be kept low, preferably below 1% volume, see section [0102] of US-2002/0121319-A1. Within the examples, times and temperatures of heat treatments are given but at no point are the temperatures or times disclosed adequate in attempting the dissolution of $Mg_2Si$ constituent particles, i.e. homogenisation temperature of up to 900° F. (482° C.) and solution treatment temperature of up to 900° F. (482° C.).

However, it has been found in accordance with the invention that for various AA7000-series aluminum alloys, the generally perceived constituent phase $Mg_2Si$ is soluble via carefully controlled heat treatment and if they cannot be taken in complete solution then their morphology can be spherodised in such a way that fatigue and/or fracture toughness properties are improved. Once in solid solution, most of the Si and/or Mg will be available for subsequent ageing that may further enhance mechanical and corrosion properties. By deliberately increasing the Si content in the alloys according to this invention more of this Si is available for subsequent ageing practices but without having the detrimental coarse $Mg_2Si$ phases in the final product. The gained improvements by the purposive addition of Si could also be sacrificed to some extent by making the alloy composition leaner in Mg and/or Cu thus improving the toughness of the alloy product. Thus the generally perceived detrimental impurity element Si is now being converted into a purposive alloying element having various advantageous technical effects.

For the AA7000-series alloys the upper limit for the Si content is about 0.35%, and preferably of about 0.25%, as a too high Si content may result in the formation of too coarse $Mg_2Si$ phases which cannot be taken in complete solid solution and thereby adversely affecting the property improvements gained. For the AA7000-series alloys the lower limit for the Si-content is >0.12%. For these alloy systems a more preferred lower limit for the Si-content is about 0.15%, and furthermore preferably about 0.17%.

A wrought AA7000-series alloy product that can be processed favorably according to the method of this invention, comprises, in wt. %:

Zn about 3 to 10%
Mg about 1 to 3%
Cu 0 to about 2.5%
Fe <0.25%, preferably <0.10%
Si >0.12 to 0.35%, preferably >0.12 to 0.25%, more preferably about 0.15 to 0.25%,
one or more elements selected from the group consisting of:

| | |
|---|---|
| Zr | at most about 0.5, preferably 0.03 to 0.20 |
| Ti | at most about 0.3 |
| Cr | at most about 0.4 |
| Sc | at most about 0.5 |
| Hf | at most about 0.3 |
| Mn | at most about 0.4, preferably <0.3 |
| V | at most about 0.4 |
| Ag | at most about 0.5%, |

the alloy optionally containing at most:

about 0.05 Ca
about 0.05 Sr
about 0.004 Be, balance being Al, incidental elements and impurities. Typically such impurities are present each <0.05%, total <0.15%

In a preferred embodiment the alloys processed using the method according to this invention have a lower limit for the Zn-content of about 5.5% and preferably about 6.1%, and more preferably of about 6.4%. And a more preferred upper limit for the Zn content is about 8.5%, and more preferably about 8.0%.

In a preferred embodiment the alloys processed using the method according to this invention have a preferred upper limit for the Mg content of about 2.5%, and preferably about 2.0%, and more preferably of about 1.85%.

In a preferred embodiment the alloys processed using the method according to this invention have a lower limit for the Cu-content of about 0.9% and more preferably about 1.1%. A more preferred upper limit for the Cu content is about 2.1%, and more preferably about 1.9%.

Traditionally, beryllium additions have served as a deoxidizer/ingot cracking deterrent. Though for environmental, health and safety reasons, more preferred embodiments of this invention are substantially Be-free. Minor amounts of Ca and Sr alone or in combination can be added to the alloy for the same purposes as Be.

The Fe content for the alloy should be less than 0.25%. When the alloy product is used for aerospace application preferably the lower-end of this range is preferred, e.g. less than about 0.10%, and more preferably less than about 0.08% to maintain in particular the toughness at a sufficiently high level. Where the alloy product is used for tooling plate application, a higher Fe content can be tolerated. However, it is believed that also for aerospace application a moderate Fe content, for example about 0.09 to 0.13%, or even about 0.10 to 0.15%, can be used. Although the skilled person would believe that this has an adverse effect on the toughness of the product, some of this loss in properties, if not all, is gained back when using the method according to this invention. The resultant would be an alloy product, although having moderate Fe levels, but when processed according to this invention it has properties equivalent to the same alloy product except for a lower Fe content, e.g. 0.05 or 0.07%, when processed using regular practice. Thus similar properties are achieved at higher Fe-levels, which has a significant cost advantage as source material having very low Fe-contents is expensive.

Silver in a range of at most about 0.5% can be added to further enhance the strength during ageing. A preferred lower limit for the Ag addition would be about 0.03% and more preferably about 0.08%. A preferred upper limit is about 0.4%.

Each of the dispersoid forming elements Zr, Sc, Hf, V, Cr and Mn can be added to control the grain structure and the quench sensitivity. The optimum levels of dispersoid formers depend on the processing, but when one single chemistry of main elements (Zn, Cu and Mg) is chosen within the preferred window and that chemistry will be used for all relevant products forms, then Zr levels are less than about 0.5%.

A preferred maximum for the Zr level is 0.2%. A suitable range of the Zr level is about 0.03 to 0.20%. A more preferred upper-limit for the Zr addition is about 0.15%. Zr is a preferred alloying element in the alloy product when processed according to this invention. Although Zr can be added in combination with Mn, for thicker gauge products manufactured using the method of this invention it is preferred that when Zr is added that any addition of Mn is avoided, preferably by keeping Mn at a level of less than 0.03%. In thicker gauge product the Mn phases coarsens more rapid than the Zr phases, thereby adversely affecting the quench sensitivity of the alloy product.

The addition of Sc is preferably not more than about 0.5% or more preferably not more than 0.3%, and even more preferably not more than about 0.18%. When combined with Sc, the sum of Sc+Zr should be less then 0.3%, preferably less than 0.2%, and more preferably at a maximum of about 0.17%, in particular where the ratio of Zr and Sc is between 0.7 and 1.4%.

Another dispersoid former that can be added, alone or with other dispersoid formers is Cr. Cr levels should preferably be below about 0.4%, and more preferably at a maximum of about 0.3%, and even more preferably about 0.2%. A preferred lower limit for the Cr would be about 0.04%. Although Cr alone may not be as effective as solely Zr, at least for use in tooling plate of the alloy wrought product, similar hardness results may be obtained. When combined with Zr, the sum of Zr+Cr should not be above about 0.23%, and preferably not more than about 0.18%.

The preferred sum of Sc+Zr+Cr should not be above about 0.4%, and more preferably not more than 0.27%.

In another embodiment of the aluminum alloy wrought product according to the invention the alloy product is free of Cr, in practical terms this would mean that the Cr content is at regular impurity levels of <0.05%, and preferably <0.02%, and more preferably the alloy is essentially free or substantially free from Cr. With "substantially free" and "essentially free" we mean that no purposeful addition of this alloying element was made to the composition, but that due to impurities and/or leaching from contact with manufacturing equipment, trace quantities of this element may, nevertheless, find their way into the final alloy product. In particular for thicker gauge products (e.g. more than 3 mm) the Cr ties up some of the Mg to form $Al_{12}Mg_2Cr$ particles which adversely affect quench sensitivity of the wrought alloy product, and may form coarse particles at the grain boundaries thereby adversely affecting the damage tolerance properties.

Mn can be added as a single dispersoid former or in combination with one of the other dispersoid formers. A maximum for the Mn addition is about 0.4%. A suitable range for the Mn addition is in the range of about 0.05 to 0.4%, and preferably in the range of about 0.05 to 0.3%. A preferred lower limit for the Mn addition is about 0.12%. When combined with Zr, the sum of Mn plus Zr should be less then about 0.4%, preferably less than about 0.32%, and a suitable minimum is about 0.12%.

In another embodiment of the aluminum alloy product according to the invention the alloy is free of Mn, in practical terms this would mean that the Mn-content is <0.03%, and preferably <0.02%, and more preferably the alloy is essentially free or substantially free from Mn. By "substantially free" and "essentially free" we mean no purposeful addition of this alloying element was made to the composition, but that due to impurities and/or leaching from contact with manufacturing equipment, trace quantities of this element may, nevertheless, find their way into the final alloy product.

In another preferred embodiment of the aluminum alloy wrought product according to this invention, the alloy has no deliberate addition of V such that it is only present, if present, at regular impurity levels of less than 0.05%, preferably less than 0.02%.

In a further embodiment, the alloys according to this invention have a chemical composition within the ranges of AA7010, AA7040, AA7140, AA7050, AA7081, or AA7085, plus modifications thereof, except they have the higher Si of the present invention in the above-described range of >0.12 to 0.35%, or the higher Si of the present invention in an above-described preferred narrower Si range.

In a preferred embodiment a wrought AA7000-series alloy product according to this invention, consists essentially of, in wt. %:

Zn about 3 to 10%

Mg about 1 to 3%

Cu 0 to about 2.5%

Fe <0.25%, preferably <0.10%

Si >0.12 to 0.35%, preferably >0.12 to 0.25%, more preferably about 0.15 to 0.25%, one or more elements selected from the group consisting of:

| | |
|---|---|
| Zr | at most about 0.5, preferably 0.03 to 0.20 |
| Ti | at most about 0.3 |
| Cr | at most about 0.4 |
| Sc | at most about 0.5 |
| Hf | at most about 0.3 |
| Mn | at most about 0.4, preferably <0.3 |
| Ag | at most about 0.5%, |

and further optionally containing at most:

about 0.05 Ca about 0.05 Sr about 0.004 Be, balance being Al, incidental elements and impurities. Typically such impurities are present each <0.05%, total <0.15%.

In another preferred embodiment a wrought AA7000-series alloy product that can be processed favourable according to this invention, consists essentially of, in wt. %:

| | |
|---|---|
| Zn | 7.0 to 8.0 |
| Mg | 1.2 to 1.8 |
| Cu | 1.3 to 2.0 |
| Fe | <0.10, preferably <0.08 |
| Si | >0.12 to 0.35%, preferably >0.12 to 0.25% |
| Zr | 0.08 to 0.15 |
| Mn | <0.04, preferably <0.02 |
| Cr | <0.04, preferably <0.02 |
| Ti | <0.06, |

the alloy optionally containing at most:

about 0.05 Ca about 0.05 Sr about 0.004 Be, balance being Al, incidental elements and impurities. Typically such impurities are present each <0.05%, total <0.15%.

The AA7000-series alloy product manufactured according to this invention can be used as an aerospace structural component, amongst others as fuselage sheet, fuselage frame member, upper wing plate, lower wing plate, thick plate for machined parts, thin sheet for stringers, spar member, rib member, floor beam member, and bulkhead member.

In the following, the invention will be explained by the following non-limitative examples.

EXAMPLES

Example 1

Two aluminum alloys have been cast having a composition as given in Table 1, and wherein the alloy with 0.02% Si is according to the prior art and the one with 0.23% Si is according to this invention. A regular Ti—C grain refiner was used. The ingots were machined into rolling blocks of 80×80×100 mm. Alloy 1 was given a single homogenisation treatment according to the prior art and that consisted of a controlled heat-up of 30° C./hr from ambient temperature to 470° C. with a 14 hour soak at 470° C. Whereas alloy 2 was given a two-step homogenisation treatment according to the invention that consisted of a controlled heat-up of 30° C./hr from ambient temperature to 470° C. with a 14 hour soak at 470° C., this was followed by a controlled heat-up to 525° C. at 30° C./hr and 7 hours soak. Once the samples had air-cooled, they were preheated to 430° C. and hot-rolled to final gauge of 30 mm. Samples were then solution heat treated at 475° C. with a one-hour soak and then cold water quenched. The samples were then aged to a T76 condition, and subsequently tested for their mechanical properties in three orientations (L, LT, and ST) according to ASTM-E8 standard. The results of which are listed in Table 2, and wherein "TYS" stands for Tensile Yield Strength, "UTS" for Ultimate Tensile Strength and "El" for elongation at fracture. All testing has been done at ½ T.

From the results of Table 2 it can be seen that alloy 2 although having a higher Si content has strength levels better than alloy 1 processed according to prior art practice.

TABLE 1

Composition of the alloys, in wt. %, balance Al and regular impurities.

| Alloy | Zn | Mg | Cu | Si | Fe | Zr |
|---|---|---|---|---|---|---|
| 1 | 7.5 | 1.4 | 1.7 | 0.02 | 0.03 | 0.11 |
| 2 (inv.) | 7.6 | 1.5 | 1.7 | 0.23 | 0.03 | 0.11 |

TABLE 2

Mechanical properties of the alloys tested for 3 orientations.

| | L-direction | | | LT-direction | | | ST-direction | | |
|---|---|---|---|---|---|---|---|---|---|
| Alloy | TYS (MPa) | UTS (MPa) | El. (%) | TYS (MPa) | UTS (MPa) | El. (%) | TYS (MPa) | UTS (MPa) | El. (%) |
| 1 | 492 | 525 | 15 | 485 | 520 | 15 | 485 | 522 | 4 |
| 2 | 512 | 537 | 12 | 505 | 535 | 11 | 491 | 535 | 4 |

Example 2

On a pilot scale of testing a billet have been DC-cast having a diameter of 250 mm and a length of over 850 mm. The alloy composition is listed in Table 3, and whereby it is noticed that alloy 3 has an Fe content slightly higher than what is currently customary for aerospace grade rolled products. Alloy 3 would be a typical example of the AA7085 series alloy. From the billet two rolling blocks have been machined having dimensions of 150×150×300 mm. By following this route blocks with an identical chemistry were obtained making it easier to fairly assess the influence of the heat treatments at a later stage on the properties. The blocks were all homogenised using the same cycles of 19 hours at 470° C. whereby industrial heat up rates and cooling rates were applied. Depending on the block a further homogenisation treatment according to the invention was applied whereby the furnace temperature is further increased and where after a second heat treatment or homogenisation treatment of 10 hours at 525° C. was applied. Following the homogenisation the blocks were cooled to room temperature. Thereafter all the blocks were preheated for 5 hours at 450° C. in one batch and hot rolled from 150 to 60 mm. The entrance temperatures (surface measurements) were in the range of 430 to 440° C. and mill exit temperatures varied in the range of 380 to 390° C. After hot rolling the plates received a one or two step solution heat treatment followed by a cold water quench. After a delay of 72 hours the plates were aged to the same T76 temper using a 3-step ageing practice, viz. 6 hours at 120° C., then 12 hours at 154° C. and followed by 24 hours at 120° C. The plates were not stretched prior to ageing. All heat treatments are summarised in Table 4.

The average mechanical properties according to ASTM-B557 standard over 2 samples of the 60 mm plates produced with the various heat treatments are listed in Table 5 and wherein "TYS" stands for Tensile Yield Strength in MPa, UTS for Untimate Tensile Strength in MPa, "El" stands for elongation at fracture in %, and "Kq" for the qualitative fracture toughness in MPa√m. The fracture toughness has been measured in accordance with ASTM B645. The L, LT, L-T and T-L testing was done at ¼ T while ST tensile testing and S-L fracture toughness was done at ½ T.

TABLE 3

Composition of the alloys, in wt. %, balance Al and regular impurities.

| Alloy | Si | Fe | Cu | Mn | Mg | Cr | Zn | Ti | Zr |
|---|---|---|---|---|---|---|---|---|---|
| 3 | 0.18 | 0.09 | 1.6 | <0.01 | 1.4 | <0.01 | 7.5 | 0.04 | 0.12 |

TABLE 4

Sample codes -v- various heat treatment routes.

| Sample | Homogenisation | Preheat | SHT | T76 ageing |
|---|---|---|---|---|
| 3A1 | 19 hrs@470° C. | 5 hrs@450° C. | 2 hrs@475° C. | 3 step |
| 3A2 | 19 hrs@470° C. | 5 hrs@450° C. | 2 hrs@475 + 1 hr@525° C. | 3 step |
| 3B1 | 19 hrs@470 + 10 hrs@525° C. | 5 hrs@450° C. | 2 hrs@475° C. | 3 step |
| 3B2 | 19 hrs@470 + 10 hrs@525° C. | 5 hrs@450° C. | 2 hrs@475 + 1 hr@525° C. | 3 step |

TABLE 5

Mechanical properties of the various 60 mm plates.

| | L | | | LT | | | ST | | | Kq | | |
|---|---|---|---|---|---|---|---|---|---|---|---|---|
| Sample | TYS | UTS | El | TYS | UTS | El | TYS | UTS | EL | L-T | T-L | S-L |
| 3A1 | 414 | 436 | 15.1 | 426 | 456 | 10.8 | 414 | 449 | 4.0 | 37 | 31 | 24 |
| 3A2 | 442 | 465 | 13.2 | 452 | 480 | 8.5 | 434 | 468 | 3.7 | 40 | 38 | 29 |
| 3B1 | 415 | 440 | 16.5 | 425 | 458 | 11.0 | 400 | 444 | 4 | — | — | — |
| 3B2 | 443 | 460 | 13.5 | 453 | 483 | 11.8 | 439 | 476 | 7.0 | 45 | 37 | 35 |

From the results of Table 5 with respect to the mechanical properties the following can be seen:

Compared to standard processing (Sample 3A1) the variants with a two step treatment according to the invention (Samples 3A2 and 3B2) show a significant increase in toughness, especially in the S-L orientation. It seems that a combined two step homogenisation treatment (Sample 3B2) plus a two step SHT according to this invention provides the best toughness results.

An increase in TYS and UTS is observed for the plates that received a two step SHT (Samples 3A2 and 3B2). However, a two step homogenisation combined a with single step SHT (sample 3B1) gives no improvement. It is not fully clear at the moment, but an assumption is that quenching after SHT from a higher temperature has a positive effect on the ageing responds of Cu containing AA7000-series alloys. Nevertheless, the obtained 20-30 MPa strength increase is considered as an important advantage of the two step SHT according to his invention.

Also the elongation, in particular in ST direction, is significantly improved using the process according to this invention.

Further improvement in toughness can be made by lowering the Fe content to standard aerospace alloy levels.

Sample 3B2 has been tested also for its corrosion resistance in an EXCO test according to ASTM G34, and had a good performance of "EA".

TABLE 7

Sample codes -v- various heat treatment routes.

| Sample | Homogenisation | Preheat | SHT | ageing |
|---|---|---|---|---|
| 4A1 | 8 hrs@470° C. | 5 hrs@450° C. | 2 hrs@475° C. | 24 hrs@120° C. |
| 5A1 | 8 hrs@470° C. | 5 hrs@450° C. | 2 hrs@475° C. | 24 hrs@120° C. |
| 5A2 | 8 hrs@470° C. | 5 hrs@450° C. | 2 hrs@475 + 1 hr@525° C. | 24 hrs@120° C. |
| 5B1 | 8 hrs@470 + 9 hrs@525° C. | 5 hrs@450° C. | 2 hrs@475° C. | 24 hrs@120° C. |
| 5B2 | 8 hrs@470 + 9 hrs@525° C. | 5 hrs@450° C. | 2 hrs@475 + 1 hr@525° C. | 24 hrs@120° C. |

TABLE 8

Mechanical properties of the various 60 mm plates.

| | L | | | LT | | | ST | | | Kq | | |
|---|---|---|---|---|---|---|---|---|---|---|---|---|
| Sample | TYS | UTS | El | TYS | UTS | El | TYS | UTS | EL | L-T | T-L | S-L |
| 4A1 | 319 | 360 | 22.0 | 322 | 374 | 16.9 | 310 | 348 | 2.9 | 55 | 51 | 28 |
| 5A1 | 310 | 354 | 20.5 | 310 | 362 | 15.4 | 300 | 347 | 5.3 | 46 | 30 | 25 |
| 5A2 | 308 | 357 | 19.4 | 309 | 366 | 16.2 | 303 | 348 | 6.3 | 49 | 35 | 30 |
| 5B1 | 308 | 354 | 21.1 | 309 | 363 | 17.0 | 300 | 350 | 5.7 | 48 | 35 | 27 |
| 5B2 | 304 | 356 | 21.9 | 309 | 366 | 18.5 | 304 | 355 | 7.7 | 49 | 39 | 33 |

Example 3

In a similar approach as with Example 2, two Cu-free 7xxx-series alloys have been produced, the chemical compositions are listed in Table 6. The alloy compositions fall within the compositional range of AA7021. These alloys were processed in a similar approach as with Example 2 and the thermal history is listed in Table 7. The ageing treatment consisted of 24 hours at 120° C. and quenching. The plates were not stretched prior to ageing. The average mechanical properties measured are listed in Table 8.

TABLE 6

Composition of the alloys, in wt. %, balance Al and regular impurities.

| Alloy | Si | Fe | Cu | Mn | Mg | Cr | Zn | Ti | Zr |
|---|---|---|---|---|---|---|---|---|---|
| 4 | 0.04 | 0.07 | <0.01 | <0.01 | 1.21 | <0.01 | 5.1 | 0.04 | 0.12 |
| 5 | 0.20 | 0.08 | <0.01 | <0.01 | 1.27 | <0.01 | 5.2 | 0.04 | 0.12 |

From the results of Table 8 with respect to the mechanical properties the following can be seen:

Compared to standard processing (Sample 5A1) the variants with a two step treatment according to the invention (Samples 5A2, 5B1, and 5B2) show a significant increase in toughness, especially in the S-L orientation. It seems that a combined two step homogenisation treatment (Sample 5B2) plus a two step SHT according to this invention provides the best toughness results.

The strength is for all variants (5A1 to 5B2) about the same. An increase in ultimate strength and yield strength is not observed in contrast to the results of Example 2 for the Cu containing AA7xxx-series alloys. This result cannot be readily explained.

Compared to the high Si variant (Sample 5A1) the low Si variant (Sample 4A1) the initial toughness values are obviously higher for the low Si alloy composition. However, after two step heat treatment according to this invention the values of the high Si alloy come close to the low Si alloy. The toughness values of the 5B2 sample are still somewhat lower but this is probably due to the fact that 525° C. for the second SHT might just be to low to dissolve all $Mg_2Si$. Employing a higher two step temperature according to the invention would further improve the toughness of the Alloy 5 variants.

Also the elongation, in particular in ST direction, is significantly improved using the process according to this invention.

It is believed that the toughness can be further improved by lowering the Fe content in the aluminum alloy.

Having now fully described the invention, it will be apparent to one of ordinary skill in the art that many changes and modifications can be made without departing from the spirit or scope of the invention as herein described.

The invention claimed is:

1. A method of manufacturing a wrought aluminum alloy product of an AA7000-series alloy, the method consisting of the steps of:

a. casting stock of an ingot of an AA7000-series aluminum alloy having 0.15 to 0.35% Si, and at least 0.9% Cu;
b. preheating and/or homogenizing the cast stock at a temperature of less than 500° C.;
c. heat treating the cast stock at a temperature in a range of more than 500° C. but lower than the solidus temperature of the subject aluminium alloy;
d. hot working the stock by rolling;
e. optionally cold working the hot worked stock;
f. first solution heat treating (SHT) of the hot worked and optionally cold worked stock;
g. second solution heat treating of the worked stock at a higher temperature than the first SHT, the temperature being in a range of more than 500° C. but lower than the solidus temperature of the subject aluminium alloy;
h. cooling the SHT stock;
i. stretching or compressing the cooled SHT stock or otherwise cold working the cooled SHT stock to relieve stresses;
j. ageing the cooled and stretched or compressed or otherwise cold worked SHT stock to achieve a desired temper, and wherein heat treatments c and g are carried out at a temperature in a range of more than 500° C. but lower than the solidus temperature of the subject aluminum alloy to dissolve constituent phase $Mg_2Si$, and wherein this heat treatment step c is carried out after the homogenisation heat treatment prior to hot working.

2. Method according to claim 1, wherein the AA7000-series aluminum alloy wrought product has a chemical composition comprising, in wt. %:

| | |
|---|---|
| Zn | about 3 to 10% |
| Mg | about 1 to 3% |
| Cu | about 0.9% Cu to about 2.5% |
| Fe | <0.25% |
| Si | 0.15 to 0.35%, |

balance being Al, incidental elements and impurities.

3. Method according to claim 1, wherein the AA7000-series aluminum alloy wrought product further comprises, in wt. %:

one or more elements selected from the group consisting of:

| | |
|---|---|
| Zr | at most 0.5 |
| Ti | at most 0.3 |
| Cr | at most 0.4 |
| Sc | at most 0.5 |
| Hf | at most 0.3 |
| Mn | at most 0.4 |

-continued

| | |
|---|---|
| V | at most 0.4, |
| Ag | at most 0.5. |

4. Method according to claim 1, wherein the AA7000-series aluminum alloy wrought product further comprising, in wt. %, at most 0.05% Ca, at most 0.05% Sr, at most about 0.004% Be.

5. Method according to claim 1, wherein the AA7000-series aluminum alloy wrought product has a Si-content in the range of about 0.17% to 0.35%.

6. Method according to claim 1, wherein the AA7000-series aluminum alloy wrought product has a Si-content in the range of about 0.15 to 0.25%.

7. Method according to claim 1, wherein the AA7000-series aluminum alloy wrought product further comprises an Fe content of less than 0.15%.

8. Method according to claim 1, wherein the AA7000-series aluminum alloy wrought product further comprises an Fe content of less than about 0.10%.

9. Method according to claim 1, wherein the AA7000-series aluminum alloy wrought product further comprises a Zn content of at least 5.5%.

10. Method according to claim 1, wherein the AA7000-series aluminum alloy wrought product further comprises a Zn content of at least 6.1%.

11. Method according to claim 1, wherein the AA7000-series aluminum alloy wrought product further comprises a Zn content of at least 6.4%.

12. Method according to claim 1, wherein the AA7000-series aluminum alloy wrought product further comprises a Zn content of at most 8.5%.

13. Method according to claim 1, wherein the AA7000-series aluminum alloy wrought product further comprises a Zn content of at most 8.0%.

14. Method according to claim 1, wherein the AA7000-series aluminum alloy wrought product further comprises a Mg content of at most 2.5%.

15. Method according to claim 1, wherein the AA7000-series aluminum alloy wrought product further comprises a Mg content of at most 2.0%.

16. Method according to claim 1, wherein the AA7000-series aluminum alloy wrought product further comprises a Mg content of at most 1.85%.

17. Method according to claim 1, wherein the AA7000-series aluminum alloy wrought product further comprises a Cu content of at least 1.1%.

18. Method according to claim 1, wherein the AA7000-series aluminum alloy wrought product further comprises a Cu content of at most 2.1%.

19. Method according to claim 1, wherein the AA7000-series aluminum alloy wrought product further comprises a Cu content of at most 1.9%.

20. Method according to claim 1, wherein the AA7000-series aluminum alloy wrought product further comprises a Zr content in a range of 0.03 to 0.2%.

21. Method according to claim 1, wherein the AA7000-series aluminum alloy wrought product further comprises a Mn content in a range of 0.05 to 0.4%.

22. Method according to claim 1, wherein the AA7000-series aluminum alloy wrought product further comprises a Mn content of <0.03%.

23. Method according to claim 1, wherein the AA7000-series aluminum alloy wrought product further comprises a Cr content in a range of 0.04 to 0.3%.

24. Method according to claim 1, wherein the AA7000-series aluminum alloy wrought product has a Cr content of <0.05%.

25. Method according to claim 1, wherein the AA7000-series aluminum alloy wrought product further comprises a Mn content of <0.02%.

26. Method according to claim 1, wherein the AA7000-series aluminum alloy wrought product has a chemical composition of an alloy selected from the group of AA7010, AA7040, AA7140, AA7050, AA7081, and AA7085, with the proviso that the Si content is in a range of 0.15 to 0.35%.

27. Method according to claim 1, wherein the AA7000-series aluminum alloy wrought product has a chemical composition within the range of AA7085 with the proviso that the Si content is in a range of 0.15 to 0.35%.

28. Method according to claim 1, wherein at least one of heat treatments c and g is carried out at a temperature range of >500-550° C.

29. Method according to claim 1, wherein at least one of heat treatments c and g is carried out at a temperature range of at least 510° C. but lower than the solidus temperature of the subject aluminum alloy.

30. Method according to claim 1, wherein at least one of heat treatments c and g is carried out at a temperature range of at least 520° C. but lower than the solidus temperature of the subject aluminum alloy.

31. Method according to claim 1, wherein at least one of heat treatments c and g is carried out at a temperature range of more than 500° C. to at most 540° C.

32. Method according to claim 1, wherein at least one of heat treatments c and g is carried out at a temperature range of more than 500° C. to at most 535° C.

33. Method according to claim 1, wherein the AA7000-series aluminum alloy product has a gauge of at least 3 mm.

34. Method according to claim 1, wherein the AA7000-series aluminum alloy product has a gauge of at least 30 mm.

35. Method according to claim 1, the AA7000-series aluminum alloy product has a gauge in a range of 30 to 300 mm.

36. Method according to claim 1, wherein the AA7000-series aluminum alloy product is a product selected from the group consisting of fuselage sheet, fuselage frame member, upper wing plate, lower wing plate, thick plate for machined parts, thin sheet for stringers, spar member, rib member, floor beam member, and bulkhead member.

37. Method according to claim 1, wherein the AA7000-series aluminum alloy product is a product is in the form a mold plate or a tooling plate.

38. Method according to claim 1, wherein the stretching or compressing comprises levelling or drawing or cold rolling of the cooled SHT stock.

39. Method according to claim 1, wherein the AA7000-series aluminum alloy wrought product has a Si-content in the range of about 0.23 to 0.35%.

40. The method of claim 1, wherein step b comprises homogenization to cause complete dissolution of soluble phases in the alloy composition.

41. Method according to claim 1, wherein the AA7000-series aluminum alloy wrought product has a chemical composition comprising, in wt. %:

| | |
|---|---|
| Zn | about 6.4 to 7.5% |
| Mg | about 1 to 1.4% |
| Cu | about 1.1% Cu to about 1.6% |
| Fe | ≦0.09% |
| Si | 0.15 to 0.18%, |

-continued

| | |
|---|---|
| Zr | 0.03-0.12 |
| Ti | 0.04-0.3 |
| Cr | <0.01 |
| Sc | at most 0.5 |
| Hf | at most 0.3 |
| Mn | <0.01 |
| V | at most 0.4, |
| Ag | at most 0.5, |

balance Al, incidental elements and impurities.

42. The method of claim 1, the alloy comprising 0.08 to 0.4 wt. % Ag.

43. A method of manufacturing a wrought aluminum alloy product of an AA7000-series alloy, the method consisting of the steps of:

a. casting stock of an ingot of an AA7000-series aluminum alloy having an Si-content in the range of about 0.15 to 0.35%, and at least 0.9% Cu;

b. preheating and/or homogenizing the cast stock at a temperature of less than 500° C.;

c. heat treating the cast stock at a temperature in a range of more than 500° C. but lower than the solidus temperature of the subject aluminium alloy;

d. hot working the stock by rolling;

e. cold working the hot worked stock;

f. first solution heat treating (SHT) of the hot worked and cold worked stock;

g. second solution heat treating of the worked stock at a higher temperature than the first SHT the temperature being in a range of more than 500° C. but lower than the solidus temperature of the subject aluminium alloy;

h. cooling the SHT stock;

i. stretching or compressing the cooled SHT stock or otherwise cold working the cooled SHT stock to relieve stresses;

j. ageing of the cooled and stretched or compressed or otherwise cold worked SHT stock to achieve a desired temper, and wherein the heat treatments c and g are carried out at a temperature in a range of more than 500° C. but lower than the solidus temperature of the subject aluminum alloy to dissolve constituent phase $Mg_2Si$, and wherein this heat treatment step c is carried out after the homogenisation heat treatment prior to hot working.

44. Method according to claim 43, wherein the AA7000-series aluminum alloy wrought product has a chemical composition comprising, in wt. %:

| | |
|---|---|
| Zn | about 6.4 to 7.5% |
| Mg | about 1 to 1.4% |
| Cu | about 1.1% Cu to about 1.6% |
| Fe | ≦0.09% |
| Si | 0.15 to 0.18%, |
| Zr | 0.03-0.12 |
| Ti | 0.04-0.3 |
| Cr | <0.01 |
| Sc | at most 0.5 |
| Hf | at most 0.3 |
| Mn | <0.01 |
| V | at most 0.4, |
| Ag | at most 0.5, |

balance Al, incidental elements and impurities.

45. The method of claim 43, the alloy comprising 0.08 to 0.4 wt. % Ag.

* * * * *